US007002144B1

(12) United States Patent
Palsulich et al.

(10) Patent No.: US 7,002,144 B1
(45) Date of Patent: Feb. 21, 2006

(54) TRANSFER LINE FOR MEASUREMENT SYSTEMS

(75) Inventors: David Palsulich, Boise, ID (US); Eric Swanson, Boise, ID (US); Larry Weston, Meridian, ID (US); Kevin Coyle, Boise, ID (US)

(73) Assignee: Micron Technology Inc., Boise, ID (US)

( * ) Notice: Subject to any disclaimer, the term of this patent is extended or adjusted under 35 U.S.C. 154(b) by 0 days.

(21) Appl. No.: 09/385,386

(22) Filed: Aug. 30, 1999

(51) Int. Cl.
*H01J 49/00* (2006.01)

(52) U.S. Cl. ..... 250/288; 204/603; 204/452

(58) Field of Classification Search ..... 250/288; 204/603, 452; 73/23.42
See application file for complete search history.

(56) References Cited

U.S. PATENT DOCUMENTS

| | | | |
|---|---|---|---|
| 4,420,690 | A | 12/1983 | Kuehl |
| 4,886,966 | A | 12/1989 | Matsunaga et al. |
| 4,926,021 | A | 5/1990 | Streusand et al. |
| 4,985,625 | A | 1/1991 | Hurst |
| 5,130,537 | A | 7/1992 | Okamoto et al. |
| 5,233,156 | A | 8/1993 | Chan et al. |
| 5,252,827 | A | 10/1993 | Koga et al. |
| 5,259,254 | A | 11/1993 | Zhu et al. |
| 5,315,369 | A | 5/1994 | Zadgorska et al. |
| 5,400,665 | A | 3/1995 | Zhu et al. |
| 5,597,467 | A | 1/1997 | Zhu et al. |
| 5,767,512 | A | 6/1998 | Eiden et al. |
| 5,801,820 | A | 9/1998 | Bysouth et al. |
| 5,826,632 | A | 10/1998 | Micke et al. |
| 6,474,136 | B1 * | 11/2002 | Nishina et al. ..... 73/23.42 |

OTHER PUBLICATIONS

K.E. Jarvis, et al., *Handbook of Inductively Coupled Plasma Mass Spectrometry*, N.Y., Chapman and Hall, pp. 76-78, 1992.

http://chem.external.hp.com/cag/products/icpmstec.html, "Inductively Coupled Plasma Mass Spectrometry", 4 pages, printed Mar. 16, 1999.

http://chem.external.hp.com/cag/products/ms.html, "Mass Spectrometry", 1 page, printed Mar. 17, 1999.

* cited by examiner

*Primary Examiner*—Keit T. Nguyen
(74) *Attorney, Agent, or Firm*—Knobbe, Martens, Olson & Bear, LLP

(57) ABSTRACT

An enhanced transfer system that increases the accuracy and sensitivity of a measurement system is disclosed. In one embodiment, the transfer system includes transfer tubing that transports samples from a spray chamber to an ionizer in a mass spectrometer system. The transfer system also includes a transfer gas line that is connected to the transfer tubing. The transfer gas line supplies a gas that assists with the transferring of the samples from the spray chamber to the ionizer. In one embodiment, the transfer gas line is angled relative to a portion of the transfer tubing. In another embodiment, the transfer gas line is perpendicular relative to a portion of the transfer tubing. The injected gas increases the quantity and quality of the samples transferred to the mass spectrometry system, thereby increasing the overall accuracy and sensitivity of the measurement system.

41 Claims, 3 Drawing Sheets

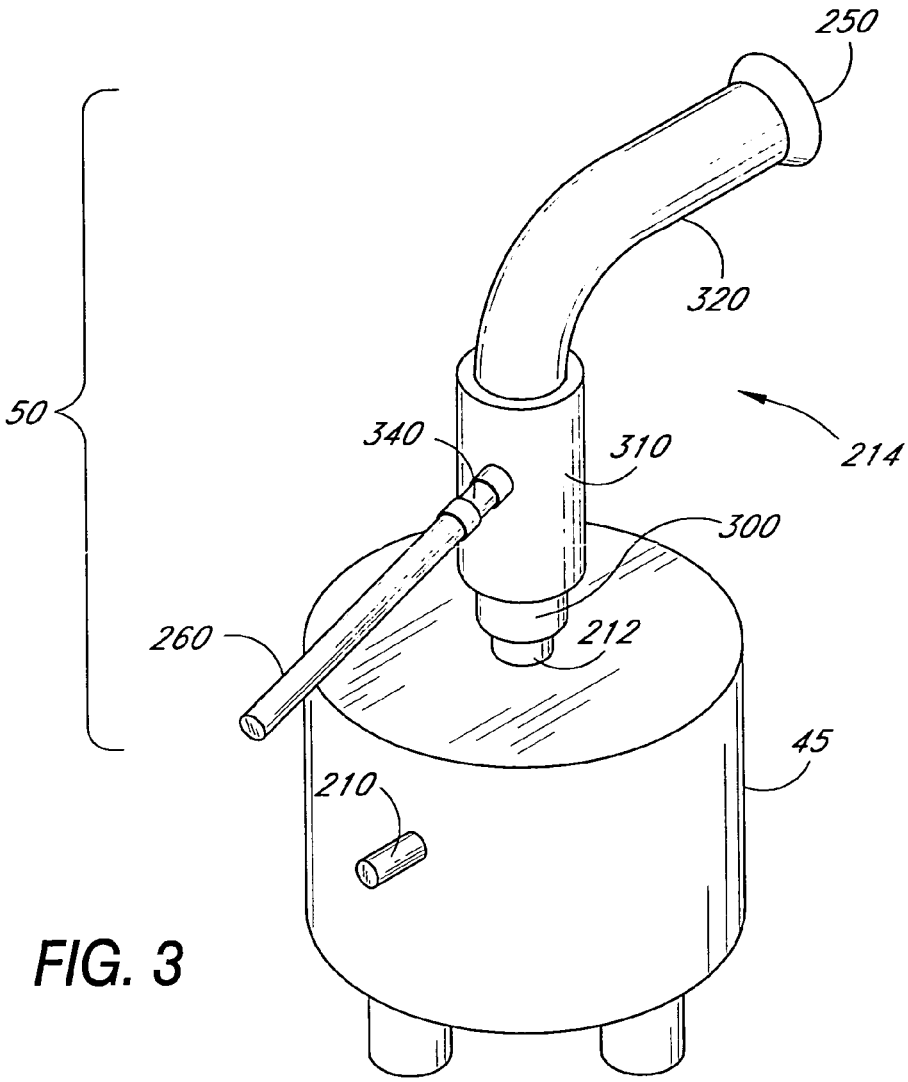
FIG. 3
FIG. 4
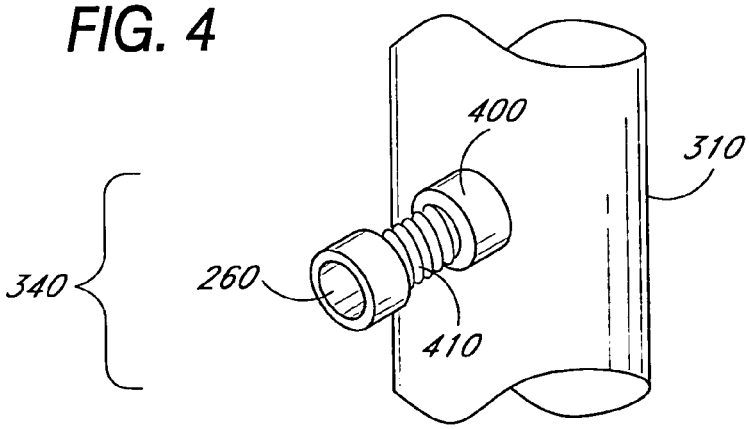

TRANSFER LINE FOR MEASUREMENT SYSTEMS

BACKGROUND OF THE INVENTION

1. Field of the Invention

The present invention relates in general to measurement systems using gas or particle detectors, such as those associated with mass spectrometry. More particularly, the invention relates to inductively coupled plasma mass spectrometry.

2. Background

Measurement systems utilizing gas or particle detectors, such as mass spectrometers, are widely known and widely used. For example, the semiconductor, environmental, geological, chemical, nuclear, clinical, and research industries all use measurement systems for a variety of composition detection. In particular, the semiconductor industry uses measurement systems for impurity analysis of many of the solutions used in the wafer fabrication process.

In a measurement system based on inductively coupled plasma mass spectrometry, the measurement system often employs a nebulizer, a spray chamber, an inductively coupled plasma torch, and a mass spectrometer. The nebulizer connects to the spray chamber. The spray chamber, in turn, is connected to the inductively coupled plasma torch. In one approach, connection tubing transfers the output of the spray chamber to the inductively coupled plasma torch. The output of the inductively coupled plasma torch, in turn, is connected to the mass spectrometer.

In general, conventional measurement systems direct a sample into the nebulizer which in turn, transforms the sample into a vapor or aerosol. The spray chamber then filters out some of the larger sample droplets in the aerosol. The remaining smaller sample droplets in the aerosol are transported by the connection tubing to the plasma torch. The plasma torch uses high-energy plasma to convert the sample into ionized atoms. The ionized atoms pass to the mass spectrometer and the mass spectrometer identifies the characteristics of the sample.

The sensitivity of conventional measurements systems is at least in part dependent on the quality and quantity of the sample which eventually reaches the mass spectrometer. To that end, designers have created measurement systems that employ carrier gases to help transport the sample. For example, carrier gases have been added to the nebulizer to try to provide uniformity in droplet size. Moreover, various carrier gases have been added to the plasma torch.

Unfortunately, many measurement systems still have drawbacks that can affect their accuracy and sensitivity. For example, after the spray chamber removes the larger sample droplets from the aerosol, the smaller droplets tend to be unstable. Instability can cause the smaller droplets to conglomerate back into larger droplets during passage through the connection tubing. In such cases, the larger reformed droplets can be trapped in the connection tubing and not only fail to reach the plasma torch, but also block properly sized droplets from passage. Thus, when large droplets form in the connection tubing, the mass spectrometer may receive fewer sample particles for analysis. Moreover, if some of the larger reformed droplets reach the plasma torch, they can distort the measurements performed by the mass spectrometer.

All of these drawbacks can cause measurement systems to provide errant impurity conclusions about the sample. In the semiconductor industry, where the samples are often solutions used in fabrication processes, such errant conclusions can lower semiconductor process yields and increase the overall cost of semiconductor manufacturing.

SUMMARY OF THE INVENTION

Accordingly, one aspect of the invention is to provide an enhanced transfer system that increases the accuracy and sensitivity of a measurement system. In one embodiment, the enhanced transfer system comprises connection tubing that is interconnected with a transfer gas line. The transfer gas line provides a gas that assists in transferring samples from a spray chamber to a mass spectrometer.

Advantageously, the novel transfer system increases sample uniformity, thereby increasing the overall accuracy and sensitivity of the measurement system. In addition, the transfer system improves the stability of the smaller, more uniform droplets transferred to the inductively coupled mass spectrometer. The transfer system also entrains more of the smaller, more uniform droplets to the ionization system. Because more of these droplets are transferred to the ionization system, the ionization system converts more of the desired aerosol into ionized atoms. Accordingly, the mass spectrometer receives more ionized atoms to process, thereby producing a more accurate and sensitive analysis of characteristics of the original sample.

Moreover, the novel transfer system increases the sample rate, allows the aerosol to travel longer distances, and increases the types of samples that can be processed. In addition, the transfer system also allows the use of a variety of different spray chambers and nebulizers.

One embodiment of the invention relates to a measurement system. The measurement system comprises a nebulizer that is configured to convert a sample into an aerosol. The measurement system further comprises a spray chamber in communication with the nebulizer wherein the spray chamber is configured to output a filtered aerosol. The measurement system also comprises an ionization system that is configured to ionize the filtered aerosol.

In addition, the measurement system comprises connection tubing. The connection tubing comprises a first end and a second end. The first end is connected to the spray chamber and the second end is connected to an ionization system. The connection tubing is configured to transport the filtered aerosol from the spray chamber to the ionization system.

The measurement system also comprises a transfer gas line in communication with the connection tubing. The transfer gas line is configured to introduce a gas into the connection tubing so as to assist with the transfer of the filtered aerosol to the ionization system.

Another embodiment of the invention relates to a transfer system. The transfer system comprises tubing which is configured to transfer analyte to an ionizer. The transfer system further comprises a transfer line in communication with the tubing, wherein the transfer line provides a carrier for the analyte.

An additional embodiment relates to a conveyance system that comprises transfer tubing. The transfer tubing is configured to transfer analyte to an ionizer. The conveyance system also comprises a gas line and a connector. The connector interconnects a portion of the transfer tubing with the gas line. The connector is configured to inject gas into the transfer tubing.

One aspect of the invention relates to a transfer system that comprises connector tubing. The connector tubing is configured to connect to the input of an ionization system. The transfer system also comprises a gas line in communication with the connector tubing, wherein the gas line injects a gas into the connector tubing.

Another aspect of the invention relates to an ionizer transport system. The ionization transport system comprises tubing that is configured to connect to the input of an ionization system. The ionization transport system also comprises a gas transfer line that is in mechanical communication with the tubing. The gas transfer line injects a carrier gas into the connector tubing. The ionization transport system also comprises a connector that interconnects the tubing with the gas transfer line.

One embodiment of the invention relates to a method for transferring an aerosol through a transfer line. The method comprises adding a transfer gas to a transfer line at an angle with respect to the transfer line. An additional embodiment relates to a method of transferring an analyte. The method comprises supplying a carrier gas to tubing that transfers the analyte from a spray chamber to an ionizer.

Another embodiment relates to a method for measuring a sample in a semiconductor processing system. The method comprises the acts of converting a sample into an aerosol and filtering the aerosol. The method further comprises transferring the filtered aerosol in a transfer tube to an ionizer, injecting gas into the transfer tube, and ionizing the filtered aerosol.

Yet another embodiment relates to a transfer system that comprises a first means for transferring analyte to an ionization system. The transfer system also comprises a second means for injecting a gas into the first means.

For the purposes of summarizing the invention, certain aspects, advantages and novel features of the invention have been described herein above. Of course, it is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

The present invention is described in more detail below in connection with the attached drawings, which are meant to illustrate and not to limit the invention, and in which:

FIG. 3 is a side view of the sample delivery system of FIG. 1, according to another embodiment of the invention; and FIG. 4 is a magnified view of the compression fitting of FIG. 3.

DETAILED DESCRIPTION OF THE PREFERRED EMBODIMENTS

While illustrated in the context of forming a transfer system for a mass spectrometer system, the skilled artisan will find application for the transfer system disclosed herein in a wide variety of contexts. For example, the disclosed transfer system has utility in a wide variety of measurement systems. In addition, while the following description provides examples of measurement systems incorporated into the semiconductor industry, it will be understood that the disclosure and its advantages are not limited to the semiconductor industry.

Figure 1:
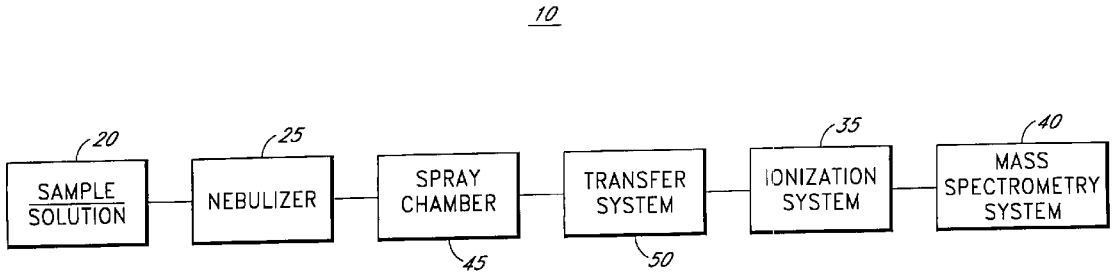
FIG. 1 is a block diagram of a measurement system, in accordance with one embodiment of the invention.

In that regard, FIG. 1 illustrates a block diagram of a measurement system 10 according to one embodiment of the invention. The measurement system 10 includes a sample solution 20, a nebulizer 25, a spray chamber 45, a transfer system 50, an ionization system 35 and a mass spectrometry system 40. In general, the measurement system 10 directs the sample solution 20 into the nebulizer 25.

The nebulizer 25 forms a vapor or aerosol comprising droplets of particles from the sample solution 20. The aerosol then passes through the spray chamber 45. The spray chamber 45 filters some of the larger droplets in the aerosol. The smaller droplets are then transferred by the transfer system 50 to the ionization system 35. The transfer system 50 combines the aerosol with a transfer gas. The transfer gas stabilizes the uniform smaller droplets and entrains them through the transfer system 50.

The ionization system 35 in one embodiment is a high-energy plasma torch that ionizes the aerosol. The ions pass to the mass spectrometry system 40 which in turn, identifies characteristics of the sample solution 20.

Because the transfer system 50 employs the transfer gas, several advantages are obtained. First, the transfer gas stabilizes the aerosol. Stabilization prevents the smaller droplets from reforming into larger droplets. Because fewer larger droplets form, less aerosol becomes trapped in the transfer system 50. Accordingly, more overall droplets of particles from the sample solution 20 are ultimately transferred to the mass spectrometry system 40 for analysis.

Moreover, the transfer gas entrains the aerosol through the transfer system 50. Accordingly, the transfer system 50 can sustain greater overall throughput of the aerosol over longer distances. Greater throughput over longer distances allows for greater flexibility in the physical layout of the measurement system 10. In addition, greater throughput over longer distances allows for adaptability of the transfer system 50 to a wide variety of different measurement systems for differing industries and technologies.

Therefore, the transfer system 50 can increase the overall throughput of stable uniform droplets of aerosol, thereby increasing the amount of desired ionized atoms ultimately reaching the mass spectrometry system 40. By increasing the amount of desired ionized atoms, the measurement system 10 increases its overall accuracy and sensitivity.

As mentioned above, the measurement system 10 measures characteristics of the sample solution 20. The sample solution 20 can be a wide variety of solutions including whatever a user of the measurement system 10 desires to analyze. For example, the semiconductor industry often monitors the purity of solutions used in the wafer and semiconductor fabrication process. These include, but are not limited to: deionized water, ammonium hydroxide ($NH_4OH$), buffered oxide etch (BOE), mixed acid etch, hydrofluoric acid (HF), hydrogen peroxide ($H_2O_2$), hydrochloric acid (HCL), isopropyl alcohol ($C_3H_8O$), vapor phase decomposition (VPD) materials, organic chemicals, and the like. However, it will be understood that one of ordinary skill in a particular industry would recognize the sample solution 20 to be a wide variety of substances from a wide variety of applications in a wide variety of industries.

The nebulizer 25 transforms the sample solution 20 into a vapor or aerosol. In this embodiment, the nebulizer is a commercially available glass expansion plastic nebulizer manufactured by Glass Expansion, Inc. In this embodiment, the nebulizer 25 mixes argon gas with the sample solution 20 to better retain the integrity of the droplets in the aerosol. The invention, however, is not limited to a particular type of nebulizer 25 and thus a variety of nebulizers 25 from a variety of manufactures can be used. For example, the nebulizer 25 can include quartz concentric, v-groove, plastic concentric, cross flow, high energy efficient, micro, pneumatic spray, thermospray, jet-impact, glass frit, and ultrasonic nebulizers 25. These are commercially available from manufactures such as Meinhardt and Glass Expansion, Inc.

In other embodiments, a variety of vaporization systems may be substituted for the nebulizer 25. For example, suitable vaporization systems could include a laser ablation device used to convert solids to aerosols. In addition, the nebulizer 25 could be replaced with devices employing electrothermal vaporization (ETV) and the like.

In yet other embodiments, the nebulizer 25 or other vaporization systems are optional. Furthermore, it is not necessary that argon be added to the nebulizer 25. It will be understood that a skilled artisan would recognize that the nebulizer 25 or other vapor systems could employ a variety of gases or simply no gas at all.

Focusing now on the spray chamber 45, in one embodiment the spray chamber 45 comprises a cyclonic spray chamber that is commercially available from Glass Expansion Inc. In other embodiments, the spray chamber 45 can by substituted with a variety of systems such as spray chamber from Sterman Masters, Wheifghte, Double Pass, and the like. In yet other embodiments, a spray chamber 45 or other filtration system may not be used.

The transfer system 50 interconnects the spray chamber 45 with the ionization system 35. In general, the transfer system 50 stabilizes and entrains the aerosol into the ionization system 35. Further details of the transfer system 50 appear below in the disclosure corresponding to FIGS. 2–4.

In one embodiment, the ionization system 35 comprises an inductively coupled plasma torch employing a high-energy radio frequency (RF) field to convert the aerosol into ionized atoms. It will be understood that the ionization system 35 could be from a wide variety of torches utilizing a wide variety of technologies. Furthermore, the ionization system 35 is not limited to torches, rather, other ionization devices could be used.

For example, the ionization system 35 could comprise a microwave induced plasma system. Furthermore, in other embodiments, the ionization system 35 may be an integral portion of the mass spectrometry system 40. In one embodiment, the mass spectrometry system 40 is commercially available from Hewlett Packard Co., however, it will be understood that a variety of mass spectrometers from a variety of manufactures could be used.

Figure 2:
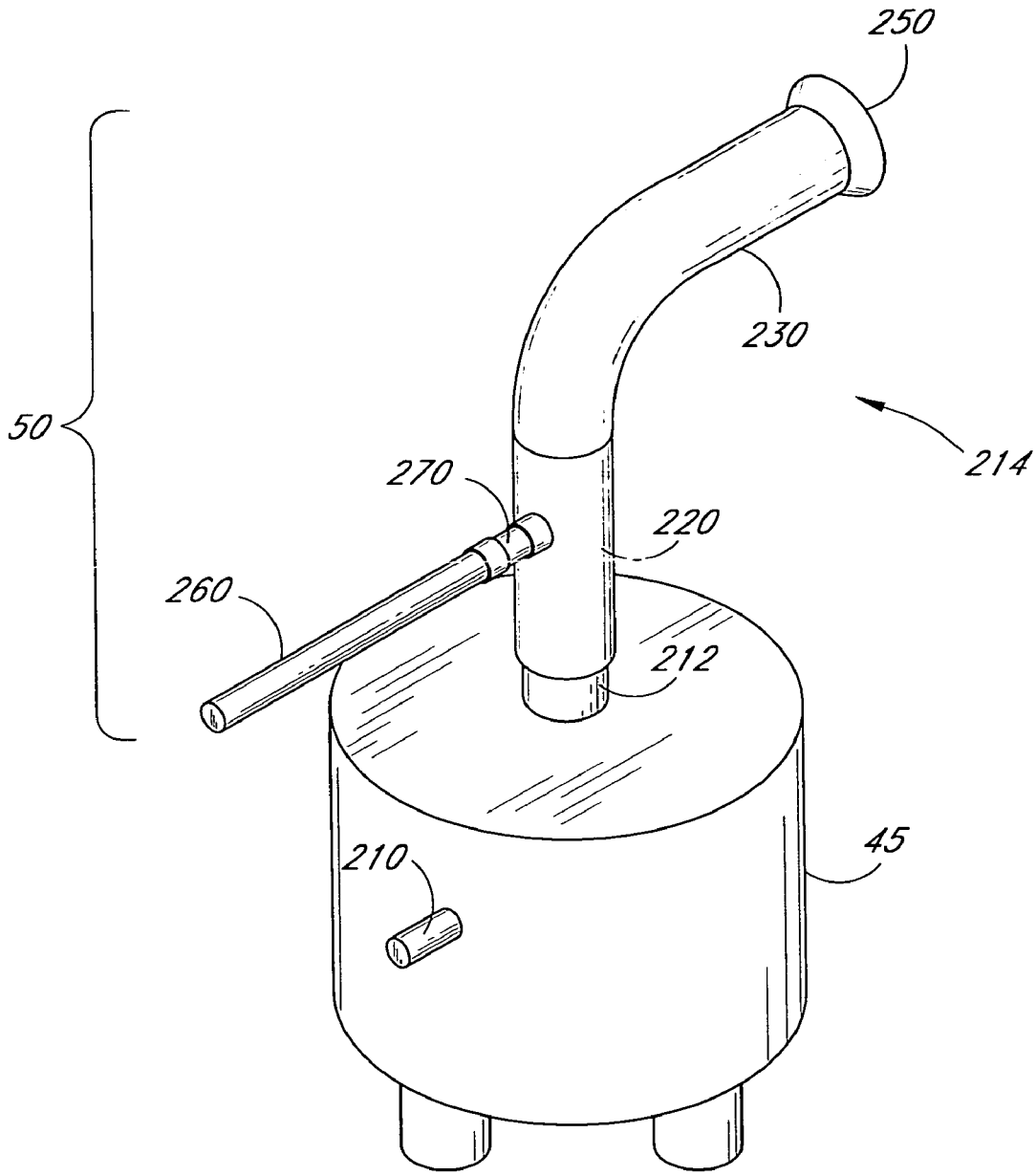
FIG. 2 is a side view of the sample delivery system of FIG. 1, according to one embodiment of the invention.

FIG. 2 illustrates the spray chamber 45 and transfer system 50 of FIG. 1, according to one embodiment of the invention. The spray chamber 45 includes an inlet 210 and an outlet 212. The inlet 210 receives the aerosol from the nebulizer 25. The outlet 212 outputs the filtered aerosol to the transfer system 50.

The transfer system 50 includes connection tubing 214 which is interconnected with a transfer gas line 260. In one embodiment, the connection tubing 214 comprises a first tubing 220 wherein one end of the first tubing 220 is connected to the outlet 212 of the spray chamber 45. The other end of the first tubing 220 is connected to a second tubing 230, which is in turn connected to an ionization connector 250. The transfer system transfers or transports analyte from the spray chamber 45 to the ionization system 25.

The transfer gas line 260 is connected to the connection tubing 214 with a transfer line connector 270. In one embodiment, the transfer line connector 270 connects the transfer gas line 260 to the first tubing 220. Accordingly, the first tubing 220 should be rigid enough to support the transfer line connector 270, yet flexible enough to attach to the outlet 212 on the spray chamber 200. In one embodiment, the first tubing 220 comprises polytetrafluorethylene (PTFE) tubing. Such PTFE tubing is commercially available from Cole-Parmer Instrument Company.

The first tubing 220 stretches radially over the outlet 212, thereby causing a friction fit between the first tubing 220 and the outlet 212. Although described as a friction fit relationship, it is understood that the connection between the first tubing 220 and the outlet 212 of the spray chamber 45 could comprise a wide variety of connections known to a skilled artisan. For example, the connection could be any of various mechanical connections, such as a male-female mating connection.

The diameter size of the first tubing 220 is based on several factors. First, the diameter should be small enough to correspond to the outlet 212 of the spray chamber 200. Second, the diameter should be large enough to avoid condensation of the aerosol within the first tubing 220. Condensation inhibits the aerosol from moving through the first tubing 220. Therefore, in one embodiment of the invention, the diameter of the first tubing 220 is approximately ⅜ of an inch.

The first tubing 220 connects to the second tubing 230 also in a friction fit relationship. For example, according to one embodiment, the second tubing 230 is flexible enough on one end to expand radially and slide over the first tubing 220, thereby creating the friction fit relationship with the first tubing 220. In addition, the second tubing 230 is flexible enough on the other end to expand radially and slide over a male cylindrical end of the ionization connector 250, thereby also forming a friction fit relationship therewith. In one embodiment the second tubing 230 comprises ⅜-inch Tygon tubing, commercially available from Norton Performance Plastics.

The ionization connector 250 comprises a ⅜-inch nylon connector adapted to attach to the ionization system 35. The ionization connector 250 is commercially available from Hewlett Packard Co. In other embodiments, connectors for other ionization systems may be used. In yet other embodiments, use of the ionization connector 250 may be altogether avoided.

The transfer system 50 also includes the transfer gas line 260 which is connected to the first tubing 220 by way of the transfer line connector 270. The transfer gas line 260 comprises 5/32 inch Teflon and is commercially available from Fluoroware, Inc., Furon Company, Parker, Atlantic Tubing, and the like. In addition, the transfer line connector 270 comprises a ⅛-inch Teflon nipple.

According to one embodiment, the Teflon nipple has a diameter that increases from one end to the center thereof, then decreases from the center thereof to an opposite end. Further, the Teflon nipple has ridges such that when the transfer gas line 260 slides over one end of the Teflon nipple, the ridges help create a friction fit relationship. The other end of the Teflon nipple slides through a hole cut in the first tubing 220. The Teflon nipple is commercially available from Norton Performance Plastics and Cole-Parmer Instrument Company.

In other embodiments, the transfer line connector 270 comprises other connectors known to a skilled artisan. In still other embodiments, use of the transfer line connector 270 can be altogether avoided and the transfer gas line 260 can be simply slid directly through a hole cut into the first tubing 220.

The transfer gas line 260 introduces a transfer gas into the transfer system 50 at a point between the spray chamber 45 and the ionization system 35. As mentioned above, introduction of the transfer gas at this point provides stabilization and improves transportation of the filtered aerosol droplets. Stabilization and transportation increases overall throughput of the aerosol and increase the distance the aerosol can travel. Greater throughput over longer distances allows for greater flexibility in the physical layout of the measurement system 10 and greater adaptability of the transfer system 50 to a variety of different measurement systems. Also, because the transfer gas ultimately provides more ionized atoms to the mass spectrometry system 40, the transfer gas enhances the overall accuracy and sensitivity of measurement system 10.

In one embodiment, the transfer gas is argon. Argon is already present in many typical measurement systems through introduction in either the vaporization system 25 or the ionization system 35. Therefore, the presence of argon is already accounted for by the mass spectrometry system 40 and does not distort its readings. However, it is understood that other transfer gases could be used. For example, the transfer gas could include helium, nitrogen, ammonia and the like.

In this embodiment, the transfer gas line 260 is generally perpendicular relative to the first tubing 220. In other embodiments discussed below, the transfer gas line 260 can be connected to the first tubing at an angle such as a non-perpendicular angle relative to the first tubing 220.

FIG. 3 illustrates the spray chamber 45 and transfer system 50 according to yet another embodiment of the invention. As described above, the spray chamber 45 comprises the inlet 210 and the outlet 212. The transfer system 50 also comprises the connection tubing 214 and the transfer gas line 260. In this embodiment, the connection tubing 214 includes a lower tubing 300 connected to a transfer gas line adapter 310. The transfer gas line adapter 310 connects to an upper tubing 320, which is in turn connected to the ionization connector 250.

The lower tubing 300 and the upper tubing 320 are flexible. The lower tubing 300 stretches radially to friction fit with the outlet 212. The upper tubing, on the other hand, stretches radially to friction fit with the ionization connector 250. Furthermore, the lower tubing 300 and the upper tubing 320 connect to the transfer gas line adapter 310 by way of fusion welding. In one embodiment, the lower tubing 300 and the upper tubing 320 comprise perflouroalkoxy (PFA) tubing. PFA tubing is commercially available from Fluoroware, Inc. and Furon Company.

The lower tubing 300 is approximately one to two inches in length and is ⅜ of an inch in diameter, while the upper tubing 320 is long enough to extend from the transfer gas line adapter 310 to the ionization system 35. In one embodiment, the upper tubing 320 is approximately 17.25 inches in length and ⅜ of an inch in diameter.

The transfer gas line adapter 310 is rigid enough to connect to the upper and lower tubing, 320 and 300, by way of fusion welding. Also, the transfer gas line adapter 310 is rigid enough to support the compression fitting 340. According to one embodiment, the transfer gas line adapter 310 comprises ¼-inch PFA Teflon pipe. PFA Teflon pipe is commercially available from Fluoroware, Inc. and Furon Company.

Use of Teflon in the connection tubing 214 is advantageous because it is resistant to chemical corrosion. However, it is understood that a wide variety of tubing could be used to meet the flexibility and rigidity characteristics of the upper tubing 320, the transfer gas line adapter 310, and the lower tubing 300.

The transfer system 50 also includes the transfer gas line 260. In one embodiment, the transfer gas line 260 comprises 5/32-inch Teflon tubing. Furthermore, in this embodiment, the transfer gas line 260 is angled with respect to the transfer gas line adapter 310. The angle is at approximately 45 degrees. In other embodiments, the angle ranges from 30 to 60 degrees. In yet other embodiments, the transfer gas line 260 is perpendicular relative to the transfer gas line adapter 310.

By positioning a portion of the transfer gas line 260 at an angle relative to the transfer gas line adapter 310, the delivery of the aerosol to the ionization system 35 is improved. Accordingly, the amount of ionized atoms ultimately delivered to the mass spectrometry system 40 is also improved. For example, when the transfer gas line 260 is positioned at approximately 45 degrees with respect to the connection tubing 214, the delivery of the ionized atoms to the mass spectrometer system 40 has increased by over 300%.

Furthermore, when the transfer gas line 260 connects at an angle, less transfer gas drifts downward towards the spray chamber 45. In one embodiment, the transfer gas is argon. As mentioned above, argon is already present in many measurement systems, and does not typically distort the readings of the mass spectrometry system 40.

As mentioned above, the transfer gas line 260 connects to the transfer gas line adapter 310 by way of the compression fitting 340. As illustrated in FIG. 4, the compression fitting 340 includes a fusion weld 400 and a threaded compression fitting 410. In one embodiment, the transfer gas line 260 slides over the threaded compression fitting 410 in order to form a friction fit relationship.

The fusion weld 400 of the compression fitting 340 determines the angle that the transfer gas line 260 introduces the transfer gas into the transfer gas line adapter 310. As mentioned, in one embodiment, the compression fitting 340 is welded to the transfer gas line adapter 310 at approximately a 45-degree angle. The welding is accomplished by heating both the transfer gas line adapter 310 and the compression fitting 340 to approximately 900° F. The compression fitting 340 is then inserted into the transfer gas line adapter 310 and allowed to cool. After cooling, a ⅛ inch drill bit is used to bore a hole in the compression fitting 340. Using the compression fitting 340 reduces leakage and accordingly increases pressure.

According to other embodiments, the compression fitting 340 comprises other connections either recognizable to an artisan, or disclosed herein in connection with other embodiments. For example, the compression fitting 340 could comprise the Teflon nipple, or simply no fitting at all.

The transfer system 50 illustrated in FIG. 3 has distinct advantages over conventional measurement systems. For example, the transfer system 50 is more chemical resistant, entrains more aerosol more quickly through the measurement system 10, has greater overall aerosol throughput, and provides less instrument drift. All of these factors tend to make the measurement system 10 more stable, more accurate, and more sensitive, thereby dramatically increasing its operability.

In addition, the use of the disclosed embodiments of the transfer system 50 increases the pressure of the aerosol in the measurement system 10. For example, the pressure of the aerosol in the transfer system 50 typically varies from 0.2 to 2.0 mil/minute. Typically, the pressure of the argon gas added through the transfer gas line 260 varies from 0.4 to 1.4 mil/minute. However, the pressure in the transfer gas line 260 can also vary depending on the substances tested and the sample solution 20 measured.

As mentioned above, the measurement system 10 identifies characteristics of the sample solution 20. In one example, the sample solution 20 comprises HF and the mass spectrometer system 40 is measuring the amount of zinc in the HF. In this example, the flow of the sample from the spray chamber 45 varies from 0.2 mil/minute to 2 mils/minute. The argon gas in the transfer gas line 260 is also injected at 0.2 mil/minute.

In another example, the mass spectrometer system 40 is measuring the amount of iron, potassium or calcium in the HF. In this example, the argon gas in the transfer gas line 260 is injected at approximately 0.6 mil/minute.

In yet another embodiment, the connection tubing 214 is wrapped with heated tape. The heated tape maintains a more uniform temperature in the connection tubing 214. The heated tape is commercially available from plumbing equipment providers such as Home Depot.

Although the foregoing invention has been described in terms of certain preferred embodiments, other embodiments will be apparent to those of ordinary skill in the art. For example, a wide variety of shapes and sizes of the transfer system 50 may be combined with the transfer gas line 260 to provide a suitable connection between the spray chamber 45 and the ionization system 35. Additionally, other combinations, omissions, substitutions and modifications will be apparent to the skilled artisan, in view of the disclosure herein. Accordingly, the present invention is not intended to be limited by the recitation of the preferred embodiments, but is instead to be defined by reference to the appended claims.

We claim:

1. A transfer system comprising:

tubing which is configured to transfer analyte to an ionizer; and a transfer line in communication with the tubing wherein the transfer line provides a carrier for the analyte, and wherein the transfer line is at an angle of about 30 degrees to about 60 degrees with respect to a portion of the tubing.

2. The transfer system of claim 1, wherein the carrier is a gas.

3. The transfer system of claim 1, wherein the carrier is argon gas.

4. The transfer system of claim 1, wherein the carrier is helium.

5. The transfer system of claim 1, wherein the carrier is nitrogen.

6. The transfer system of claim 1, wherein the carrier is ammonia.

7. The transfer system of claim 1, wherein the transfer line is a gas line.

8. The transfer system of claim 1, wherein the transfer line is Teflon tubing.

9. The transfer system of claim 1, wherein the transfer line has an inner diameter of 5/32 of an inch.

10. A conveyance system comprising:

transfer tubing which is configured to transfer analyte to an ionizer;

a gas line; and a connector that interconnects a portion of the transfer tubing with the gas line, the connector configured to inject gas into the transfer tubing, wherein the gas line is angled with respect to the connector at an angle that ranges from approximately 30 degrees to approximately 60 degrees.

11. The conveyance system of claim 10, wherein the connector is a hole in the transfer tubing that mates with the gas line.

12. The conveyance system of claim 10, wherein the connector is a compression fitting.

13. The conveyance system of claim 10, wherein the connector is welded to the transfer tubing.

14. The conveyance system of claim 10, wherein the connector is fusion welded to the transfer tubing.

15. The conveyance system of claim 10, wherein the connector is a nipple.

16. The conveyance system of claim 10, wherein the connector is a Teflon nipple.

17. A transfer system comprising:

connector tubing which is configured to connect to an input of an ionization system; and a gas line in communication with the connector tubing, the gas line angled at an angle of about 30 degrees to about 60 degrees relative to the connector tubing, wherein the gas line is configured to inject a gas into the connector tubing.

18. The transfer system of claim 17, wherein the connector tubing comprises a first section which is in mechanical communication with the gas line.

19. The transfer system of claim 18, wherein the first section comprises polytetrafluorethylene tubing.

20. The transfer system of claim 18, wherein the first section comprises perflouroalkoxy (PFA) tubing.

21. The transfer system of claim 20 further comprising a compression fitting that interconnects the second section with the gas line.

22. The transfer system of claim 17, wherein the connector tubing comprises a first section that is configured to connect to a spray chamber.

23. The transfer system of claim 22, wherein the connector tubing further comprises a second section that is in communication with the first section, and with the gas line.

24. The transfer system of claim 23, wherein the second section comprises Teflon.

25. The transfer system of claim 23, wherein the second section is Teflon (PFA) pipe.

26. An ionizer transport system comprising:

tubing that is configured to connect to an input of an ionization system;

a gas transfer line in mechanical communication with the tubing, wherein the gas transfer line injects a carrier into the tubing; and a connector that interconnects the tubing with the gas transfer line, wherein the gas transfer line is angled at an angle that ranges between approximately 30 degrees to approximately 60 degrees with respect to the tubing.

27. The ionizer transport system of claim 26, wherein the connector is configured to interconnect the gas transfer line at an angle relative to a portion of the tubing.

28. The ionizer transport system of claim 26, wherein the connector is configured to interconnect the gas transfer line at a 45-degree angle relative to a portion of the tubing.

29. The ionizer transport system of claim 26, wherein the connector is configured to interconnect the gas transfer line at an angle ranging from 30 degrees to 60 degrees relative to a portion of the tubing.

30. A method for transferring an aerosol through a transfer line, the method comprising adding a transfer gas to a transfer line at an angle with respect to a portion of the transfer line, wherein the angle is between approximately 30 degrees to approximately 60 degrees.

31. A method for measuring a sample in a semiconductor processing system, comprising:

converting a sample into an aerosol;

filtering the aerosol;

transferring the filtered aerosol in a transfer tube to an ionizer; and injecting gas into the transfer tube, wherein the gas is injected at an angle that ranges between about 30 degrees to about 60 degrees relative to a portion of the transfer tube.

32. The method of claim 31, wherein the gas is injected at a 45 degree angle relative to a portion of the transfer tube.

33. A method of transferring an analyte comprising supplying a carrier gas an angle that ranges between approximately 30 degrees to approximately 60 degrees with respect to tubing that transfers the analyte from a spray chamber to an ionizer.

34. The method of claim 33, wherein the carrier gas is argon gas.

35. The method of claim 33, wherein the carrier gas is helium gas.

36. The method of claim 33, wherein the carrier gas is nitrogen gas.

37. The method of claim 33, wherein the carrier gas is ammonia gas.

38. The method of claim 33 further comprising interconnecting a carrier gas line to the tubing such that the carrier gas line supplies the carrier gas.

39. A transfer system comprising:

first means for transferring analyte to an ionization system; and second means for injecting a gas into the first means, wherein the second means is angled at an angle that ranges between approximately 30 degrees to approximately 60 degrees with respect to the first means.

40. The transfer system of claim 39, further comprising a third means for interconnecting the first means with the second means.

41. The transfer system of claim 40 wherein the third means interconnects a portion of the first means with a portion of the second means at an angle relative to the portion of the second means.

* * * * *

UNITED STATES PATENT AND TRADEMARK OFFICE

CERTIFICATE OF CORRECTION

PATENT NO. : 7,002,144 B1
APPLICATION NO. : 09/385386
DATED : February 21, 2006
INVENTOR(S) : Palsulich et al.

It is certified that error appears in the above-identified patent and that said Letters Patent is hereby corrected as shown below:

In column 7, line 25 delete “perflouroalkoxy” and insert -- perfluoroalkoxy --, therefore;

In column 10, line 32 in Claim 20, delete “perflouralkoxy” and insert -- perfluoroalkoxy --, therefore;

In column 12, line 19 in Claim 41, delete “40” and insert -- 40, --, therefore;

Signed and Sealed this

Sixteenth Day of January, 2007

JON W. DUDAS
*Director of the United States Patent and Trademark Office*